US009003887B2

(12) United States Patent
Matsumoto

(10) Patent No.: US 9,003,887 B2
(45) Date of Patent: Apr. 14, 2015

(54) ULTRASONIC SENSOR

(75) Inventor: Taku Matsumoto, Nagaokakyo (JP)

(73) Assignee: Murata Manufacturing Co., Ltd., Nagaokakyo-Shi, Kyoto-Fu (JP)

( * ) Notice: Subject to any disclaimer, the term of this patent is extended or adjusted under 35 U.S.C. 154(b) by 894 days.

(21) Appl. No.: 13/114,521

(22) Filed: May 24, 2011

(65) Prior Publication Data

US 2011/0290028 A1 Dec. 1, 2011

(30) Foreign Application Priority Data

May 28, 2010 (JP) ..... 2010-123601
Mar. 23, 2011 (JP) ..... 2011-063512

(51) Int. Cl.
*G10K 9/22* (2006.01)
*G10K 9/122* (2006.01)

(52) U.S. Cl.
CPC . *G10K 9/22* (2013.01); *G10K 9/122* (2013.01)

(58) Field of Classification Search
CPC ..... G10K 9/22; G10K 9/122
USPC ..... 73/632, 645–646; 310/323.21, 324, 310/334, 336, 345
See application file for complete search history.

(56) References Cited

U.S. PATENT DOCUMENTS 3,855,847 A 12/1974 Leschek
4,408,479 A 10/1983 Asai et al.
4,703,656 A * 11/1987 Bhardwaj ..... 73/644
6,374,676 B1 * 4/2002 Arnold et al. ..... 73/632
6,520,019 B1 2/2003 Schon et al.
7,728,486 B2 6/2010 Matsuo
2008/0168841 A1 * 7/2008 Matsuo ..... 73/649
2008/0184802 A1 8/2008 Sato
2011/0290584 A1 * 12/2011 Sato ..... 181/211

FOREIGN PATENT DOCUMENTS

CA 2052034 A1 3/1992
CH 569 280 A5 4/1992
CN 101038338 A 9/2007
CN 101241183 A 8/2008
CN 101258772 A 9/2008
DE 94 06 896 U1 6/1994
DE 198 16 456 C1 6/1999
DE 103 41 900 A1 6/2004

(Continued)

OTHER PUBLICATIONS

German Office Action issued for counterpart application No. DE 10 2011 076 399.6, dated Dec. 18, 2014 (attached is English translation).

*Primary Examiner* — Laura Martin
*Assistant Examiner* — Rose M Miller
(74) *Attorney, Agent, or Firm* — Arent Fox LLP

(57) ABSTRACT

An ultrasonic sensor includes a cylindrical case having a bottom and a side wall, a piezoelectric element attached to an inner bottom surface of the case, a terminal retainer configured to hold outer terminals and inner terminals, and wires connected to the inner terminals and configured to feed power to the piezoelectric element. The side wall of the case has a thin portion adjacent to an opening of the case and a thick portion adjacent to the bottom of the case. The elastic member is provided between the thick portion and the terminal retainer. An opening region surrounded by the thick portion is preferably covered with the elastic member. The case is preferably internally filled with a filler.

11 Claims, 8 Drawing Sheets

(56) References Cited

FOREIGN PATENT DOCUMENTS

| | | | |
|---|---|---|---|
| EP | 0 477 575 | A1 | 4/1992 |
| JP | 61-120559 | A | 6/1986 |
| JP | 7119799 | B | 12/1995 |
| JP | 11-237468 | A | 8/1999 |
| JP | 2001-197592 | A | 7/2001 |
| JP | 2002-078089 | A | 3/2002 |
| JP | 2006-279113 | A | 10/2006 |
| JP | 2007-318742 | A | 12/2007 |
| JP | 2008271439 | A | 11/2008 |
| WO | WO 00/19243 | A | 4/2000 |

* cited by examiner

ULTRASONIC SENSOR

BACKGROUND OF THE INVENTION

1. Field of the Invention

The present invention relates to ultrasonic sensors. In particular, the present invention relates to an ultrasonic sensor which includes a piezoelectric element and input-output terminals electrically connected to the piezoelectric element and is used, for example, as a corner sonar or a back sonar of a car.

2. Description of the Related Art

An ultrasonic sensor is a sensor that uses ultrasonic waves to perform sensing. The ultrasonic sensor intermittently transmits ultrasonic pulse signals and receives reflected waves from surrounding obstacles to detect an object. For example, the ultrasonic sensor is used in a car as a corner sonar, a back sonar, or a parking spot sensor that detects a space between the car and an obstacle, such as a side wall, in parallel parking.

An ultrasonic sensor of this type is disclosed in Japanese Unexamined Patent Application Publication No. 2007-318742. FIG. 1 is a cross-sectional view of an ultrasonic sensor 10 disclosed in this document. The ultrasonic sensor 10 includes a case 12 having a bottom portion 14 and a tubular portion 16. The bottom portion 14 is made of metal, such as aluminum, and has a closed surface. The tubular portion 16 is made of metal, such as zinc, and fitted into and bonded by an adhesive to the bottom portion 14.

A piezoelectric element 18 is bonded, by a conductive adhesive, to an inner bottom of the bottom portion 14 of the case 12.

First and second input-output terminals 20 and 22 made of metal are electrically connected to the piezoelectric element 18. The first and second input-output terminals 20 and 22 are extracted from the inside to the outside of the case 12. The first input-output terminal 20 is electrically connected to an electrode on an upper principal surface of the piezoelectric element 18. The first input-output terminal 20 includes a spring terminal 20*a* having spring properties, a middle portion 20*b*, and a pin-like extraction portion 20*c*.

The second input-output terminal 22 is electrically connected, through the case 12, to an electrode on a lower principal surface of the piezoelectric element 18. The second input-output terminal 22 includes a connection portion 22*a*, a middle portion 22*b*, and an extraction portion 22*c*.

The first and second input-output terminals 20 and 22 are supported by a substantially columnar support member 24 made of insulating synthetic resin. The first and second input-output terminals 20 and 22 are embedded, at their middle portions 20*b* and 22*b*, in the support member 24 and secured to be integral with the support member 24.

In the interior of the case 12, the support member 24 is placed adjacent to the upper principal surface of the piezoelectric element 18 and secured to the tubular portion 16 of the case 12.

In the case 12, a damping member 26 is disposed on the closed surface where the piezoelectric element 18 is placed. In the interior of the case 12, an opening side of the support member 24 is sealed with an expandable filler (not shown).

In the ultrasonic sensor 10 of related art illustrated in FIG. 1, the support member 24 that supports the first and second input-output terminals 20 and 22 is directly attached to the tubular portion 16 that vibrates. As a result, vibrations of the tubular portion 16 are transmitted to the first and second input-output terminals 20 and 22 and vibrate a substrate on which the first and second input-output terminals 20 and 22 are mounted (hereinafter referred to as "vibration leakage").

This vibration leakage causes a long reverberation time (i.e., deteriorates reverberation characteristics). If reverberation is prolonged in detection of a nearby object, a reflected signal is received while reverberation of a transmission signal (burst wave) continues. This makes it difficult to detect a nearby object. Additionally, in the structure illustrated in FIG. 1, where a boundary between the bottom portion 14 and the tubular portion 16 is exposed to a side face of the case 12, it is necessary to take measures to prevent entry of moisture and corrosion under high humidity conditions.

An object of the present invention is to provide an ultrasonic sensor which has reverberation characteristics improved by preventing vibration leakage.

SUMMARY OF THE INVENTION

According to preferred embodiments of the present invention, an ultrasonic sensor includes a cylindrical case having a bottom and a side wall, a piezoelectric element attached to an inner bottom surface of the case, terminals extracted to the outside of the case, a terminal retainer configured to hold the terminals, and conductive members connected to the terminals and configured to feed power to the piezoelectric element. The side wall of the case has a thin portion adjacent to an opening of the case and a thick portion adjacent to the bottom of the case. The ultrasonic sensor further includes an elastic member disposed between the thick portion and the terminal retainer.

With this structure, vibrations from the case are attenuated in the elastic member and mostly prevented from being transmitted through the terminal retainer to the terminals. It is thus possible to significantly reduce vibration leakage that occurs when the terminals are mounted on a substrate.

An opening region surrounded by the thick portion may be covered with the elastic member. With this structure, sonic waves emitted from the piezoelectric element toward the interior of the case can be blocked from directly reaching the terminal retainer. It is thus possible to further reduce vibration leakage.

A space between the thin portion of the side wall and a side face of the elastic member may be filled with a filler. With this structure, the filler is in contact with the side wall of the case over a wide area. Therefore, as compared to a structure in which the thin portion and the elastic member are in contact with each other, vibrations in the side wall of the case can be suppressed and reverberation can be reduced.

A reinforcing member (weight) having an acoustic impedance higher than that of the case may be formed on the thick portion. This structure enhances rigidity of a portion around the inner bottom surface of the case, suppresses transmission of vibrations from the bottom to the side wall of the case, and thus improves sensitivity of the ultrasonic sensor.

A space may be created between the piezoelectric element and the elastic member, and a sound absorbing member may be provided on a surface of the elastic member adjacent to the piezoelectric element. With this structure, unwanted sonic waves are absorbed by the sound absorbing member. Therefore, it is possible to efficiently attenuate unwanted sonic waves transmitted from the piezoelectric element toward the interior of the case.

It may be preferable that the bottom of the case have stepped portions that produce anisotropy in a major axis direction and a minor axis direction, the elastic member have first engagement portions that engage with the respective stepped portions, the elastic member have a second engagement portion that engages with the terminal retainer, and the terminal retainer have an engagement portion that engages with the second engagement portion.

With this structure, where the case, the elastic member, and the terminal retainer are positioned with respect to each other, the terminals and the terminal retainer can be secured stably. To produce anisotropy in directivity of ultrasonic waves to be transmitted and received (i.e., to make a directivity angle in a vertical direction different from that in a horizontal direction), a thin portion with major and minor axes is typically created at the bottom of the case. However, the directivity of the thin portion cannot be identified from outside the case. Therefore, in related art, the terminal retainer is secured onto an end face of the case adjacent to the opening of the case. However, if the terminal retainer is secured onto the end face of the case, for example, entry of moisture through a boundary between the end face and the terminal retainer may cause degradation of sensitivity. In the structure described above, when the case, the elastic member, and the terminal retainer are brought into engagement with each other, the terminals are secured inside the case in accordance with the directional property of a vibrating surface of the case. Therefore, the directional property of the vibrating surface can be identified on the basis of the positions of the terminals exposed to the outside of the case.

According to the preferred embodiments of the present invention, vibrations from the case are attenuated in the elastic member and mostly prevented from being transmitted through the terminal retainer to the terminals. It is thus possible to significantly reduce vibration leakage that occurs when the terminals are mounted on a substrate. Therefore, deterioration of reverberation characteristics caused by vibration leakage can be prevented, and detection of a nearby object becomes possible.

Other features, elements, characteristics and advantages of the present invention will become more apparent from the following detailed description of preferred embodiments of the present invention with reference to the attached drawings.

DESCRIPTION OF THE PREFERRED EMBODIMENTS

First Embodiment

Figure 2A:
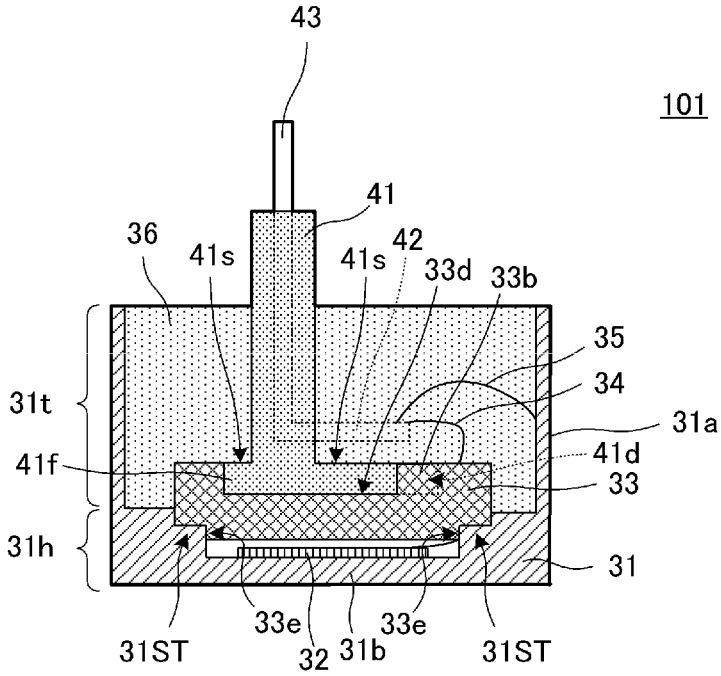
FIG. 2A is a cross-sectional view of an ultrasonic sensor according to a first embodiment of the present invention.
Figure 2B:
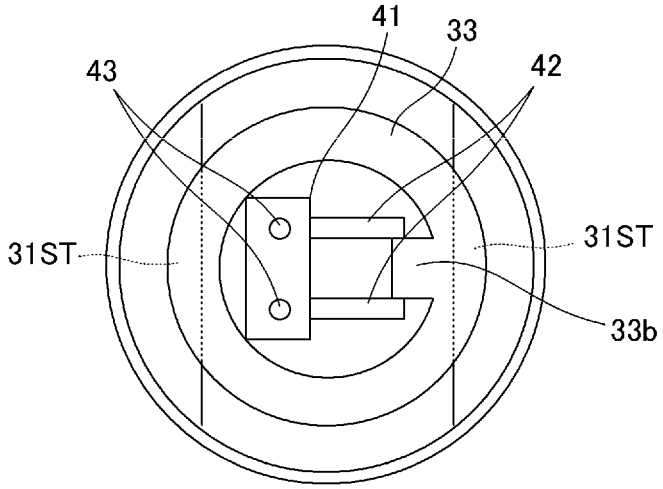
FIG. 2B is a plan view of a state before a case of the ultrasonic sensor of FIG. 2A is internally filled with a filler.

FIG. 2A is a cross-sectional view of an ultrasonic sensor 101 according to a first embodiment of the present invention. FIG. 2B is a plan view of a state before a case 31 of the ultrasonic sensor 101 is internally filled with a filler. The ultrasonic sensor 101 includes the case 31 of substantially cylindrical shape having a bottom 31*b* and a side wall 31*a*, a piezoelectric element 32 attached to an inner bottom surface of the case 31, a terminal retainer 41 configured to hold outer terminals 43 and inner terminals 42, and wires (conductive members) 34 and 35 connected to the inner terminals 42 and configured to feed power to the piezoelectric element 32.

The side wall 31*a* of the case 31 has a thin portion 31*t* adjacent to an opening of the case 31 and a thick portion 31*h* adjacent to the bottom 31*b* of the case 31. The bottom 31*b* of the case 31 has stepped portions 31ST. Broken lines in FIG. 2B indicate positions of the stepped portions 31ST at the bottom 31*b* of the case 31. An elastic member 33 is disposed between the thick portion 31*h* and the terminal retainer 41. In other words, an opening region surrounded by the thick portion 31*h* is covered with the elastic member 33.

A region surrounded by the stepped portions 31ST (indicated by the broken lines in FIG. 2B) at the bottom 31*b* of the case 31 and the inner periphery of the case 31 where the stepped portions 31ST are not present is a main vibration region, which is substantially equivalent to the inner bottom surface of the case 31. The main vibration region of the case 31 has a major (longer) axis corresponding to a direction parallel to the broken lines in FIG. 2B and a minor (shorter) axis corresponding to a direction perpendicular to the broken lines in FIG. 2B. Thus, since the main vibration region is anisotropic, anisotropy is produced in directivity of ultrasonic waves. Specifically, the directivity angle of ultrasonic waves is narrow in the major axis direction (i.e., the vertical direction in FIG. 2B) and wide in the minor axis direction (i.e., the horizontal direction in FIG. 2B).

The case 31 is internally filled with a filler 36 which is an elastic body made of silicon resin, urethane resin, or the like. The filler 36 is bonded to the inner surface of the case 31. Since the opening region surrounded by the thick portion 31*h* is covered with the elastic member 33, a space is created between the piezoelectric element 32 and the elastic member 33.

Since the outside diameter of the elastic member 33 is smaller than the inside diameter of the thin portion 31*t* of the side wall 31*a* of the case 31, the filler 36 is present between the thin portion 31*t* and the side face of the elastic member 33.

The case 31 is, for example, an aluminum forged body. The elastic member 33 is an elastic molded body made of silicon rubber, urethane resin, or the like. First engagement portions 33*e* that engage with the respective stepped portions 31ST of the case 31 are formed in the lower part of the elastic member 33. A second engagement portion 33*d* with which the terminal retainer 41 engages is formed in the upper part of the elastic member 33. The elastic member 33 is not open in the center.

The terminal retainer 41 is a molded body of resin, such as polybutylene terephthalate (PBT). The terminal retainer 41 holds about two pins, which serve as the outer terminals 43 at one end and the inner terminals 42 at the other end. The terminal retainer 41 has a flange-like engagement portion (hereinafter referred to as a "flange") 41*f* at a lower end thereof. The flange 41*f* engages with the second engagement portion 33*d* in the upper surface of the elastic member 33. An upper surface 41*s* of the flange 41*f* of the terminal retainer 41 is covered with the filler 36.

As described above, since there is the elastic member 33 between the thick portion 31*h* of the case 31 and the terminal retainer 41, vibrations from the case 31 are attenuated in the elastic member 33 and mostly prevented from being transmitted through the terminal retainer 41 to the outer terminals 43. It is thus possible to significantly reduce vibration leakage that occurs when the outer terminals 43 are mounted on a substrate. In particular, since the elastic member 33 is not open in the center, sonic waves emitted from the piezoelectric element 32 toward the interior of the case 31 hit the elastic member 33, instead of directly hitting the terminal retainer 41. Thus, sonic waves emitted from the piezoelectric element 32 toward the interior of the case 31 are attenuated in the elastic member 33. Therefore, it is possible to effectively prevent vibration leakage.

Additionally, since the upper surface 41*s* of the flange 41*f* of the terminal retainer 41 is covered with the filler 36, the terminal retainer 41 can be held firmly in place. Thus, the terminal retainer 41 is made more resistant to removal and peeling.

In terms of material nature, whereas the elastic member 33 is less prone to transmit vibrations, the filler 36 suppresses (damps) vibrations of the case 31. That is, it is preferable that the elastic modulus of the elastic member 33 be lower than that of the filler 36. More specifically, the elastic modulus can be divided into a storage modulus and a loss modulus. The elastic member 33 preferably has a lower storage modulus, and the filler 36 preferably has a higher loss modulus. For example, the elastic member 33 is preferably made of silicon resin (silicon rubber), and the filler 36 is preferably made of urethane resin.

As described above, a space between the thin portion 31*t* of the side wall 31*a* of the case 31 and the side face of the elastic member 33 is filled with the filler 36. Since the filler 36 is bonded to the side wall 31*a* of the case 31 over a wide area (large depth range), the vibration damping effect of the side wall 31*a* of the case 31 is improved. It is thus possible to reduce reverberations.

Figure 3:
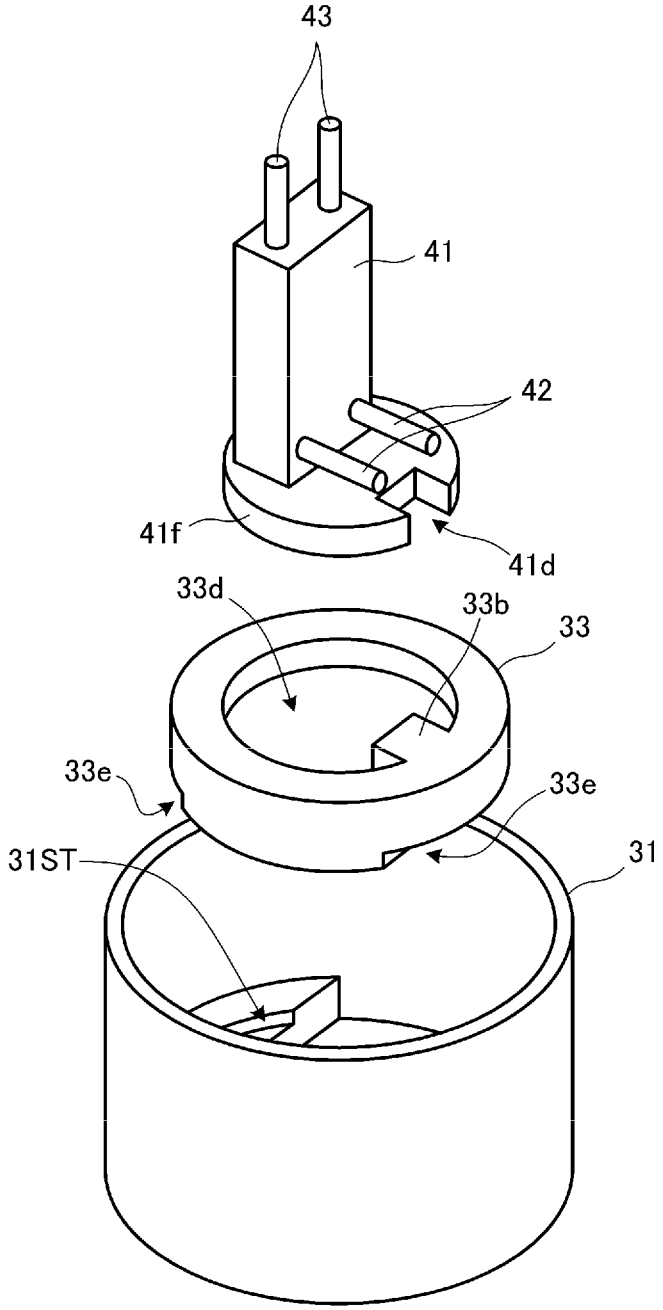
FIG. 3 is an exploded perspective view illustrating a structure of the case, an elastic member, and a terminal retainer of the ultrasonic sensor according to the first embodiment.

FIG. 3 is an exploded perspective view illustrating a structure of the case 31, the elastic member 33, and the terminal retainer 41 of the ultrasonic sensor 101. As described above, to make the main vibration region of the case 31 anisotropic, the case 31 has a pair of the stepped portions 31ST at the bottom 31*b*. FIG. 3 shows only one of the stepped portions 31ST. In the lower part of the elastic member 33, there is a pair of the first engagement portions 33*e* that engage with the respective stepped portions 31ST at the bottom 31*b* of the case 31. In the upper part of the elastic member 33, there is the second engagement portion 33*d* with which the flange 41*f* of the terminal retainer 41 engages. A protrusion 33*b* is formed in a part of the second engagement portion 33*d*.

A recess 41*d* with which the protrusion 33*b* of the elastic member 33 engages is formed in a part of the flange 41*f* of the terminal retainer 41.

The first engagement portions 33*e* of the elastic member 33 engage with the stepped portions 31ST of the case 31, and the flange 41*f* of the terminal retainer 41 engages with the second engagement portion 33*d* of the elastic member 33. Thus, by sequentially bringing these three parts into engagement, the orientation of the terminal retainer 41 with respect to the case 31 becomes stable. Therefore, even when the terminal retainer 41 is not positioned on the end face of the case 31 adjacent to the opening, the directional property of a vibrating surface of the case 31 can be identified by the positions of the outer terminals 43 exposed to the outside of the case 31.

If the case 31, the elastic member 33, and the terminal retainer 41 are temporarily secured to each other by engagement of the stepped portions 31ST with the first engagement portions 33*e* and by engagement of the second engagement portion 33*d* with the flange 41*f*, the filler 36 can be easily placed in the case 31.

Since the about two pins (which serve as the outer terminals 43 at one end and the inner terminals 42 at the other end) held by the terminal retainer 41 are molded into a substantially L-shape, there is a large space around the inner terminals 42 before the case 31 is filled with the filler 36. This allows easy connection of wires to the inner terminals 42.

Figure 4A:
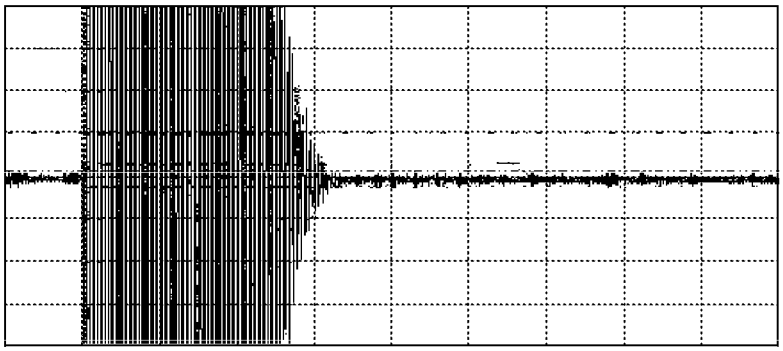
FIG. 4A is a graph showing reverberation characteristics of the ultrasonic sensor according to the first embodiment.
Figure 4B:
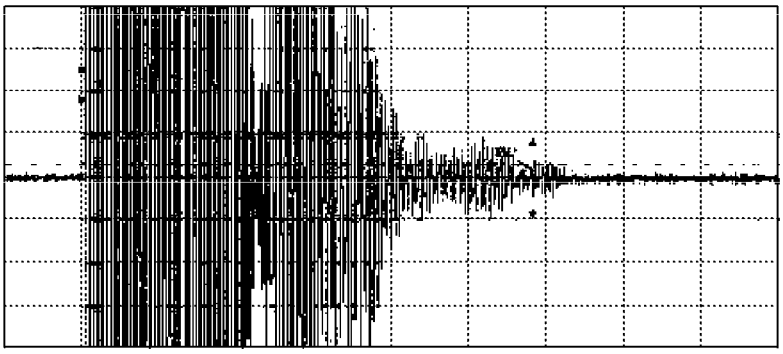
FIG. 4B is a graph showing reverberation characteristics of the ultrasonic sensor illustrated as a comparative example in FIG. 1.

FIG. 4A is a graph showing reverberation characteristics of the ultrasonic sensor 101 according to the first embodiment. FIG. 4B is a graph showing reverberation characteristics of the ultrasonic sensor 10 illustrated as a comparative example in FIG. 1. In the graphs, each division of the horizontal axis represents about 500 μs and each division of the vertical axis represents about 1 V. In both the first embodiment and the comparative example, the outer terminals were secured onto a substrate (not shown) by soldering, about eight burst waves were transmitted during the transmission time, and a voltage waveform appearing in the piezoelectric element was amplified and observed. Although attenuation of amplitude actually started immediately after the end of transmission, the waveform was saturated for a while, during which the dynamic range of the amplifying circuit was exceeded.

As is apparent from the comparison between FIG. 4A and FIG. 4B, in the ultrasonic sensor 101 of the first embodiment where the amplitude converges faster, vibration leakage and reverberations are suppressed.

Figure 1:
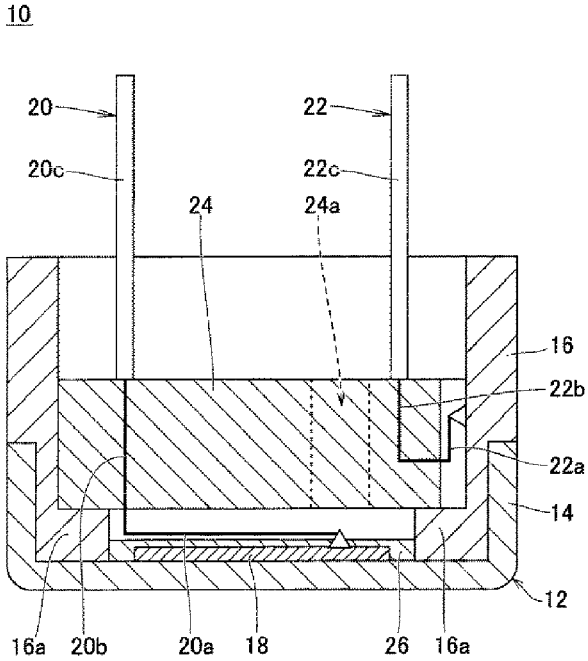
FIG. 1 PRIOR ART
FIG. 1 is a cross-sectional view of an ultrasonic sensor disclosed in Japanese Unexamined Patent Application Publication No. 2007-318742.

In the first embodiment, unlike the structure of FIG. 1, no boundary is present in the outer periphery of the case 31. Therefore, it is possible to prevent degradation of sensitivity caused by entry of water through such a boundary, and to prevent corrosion between different metals.

Second Embodiment

Figure 5A:
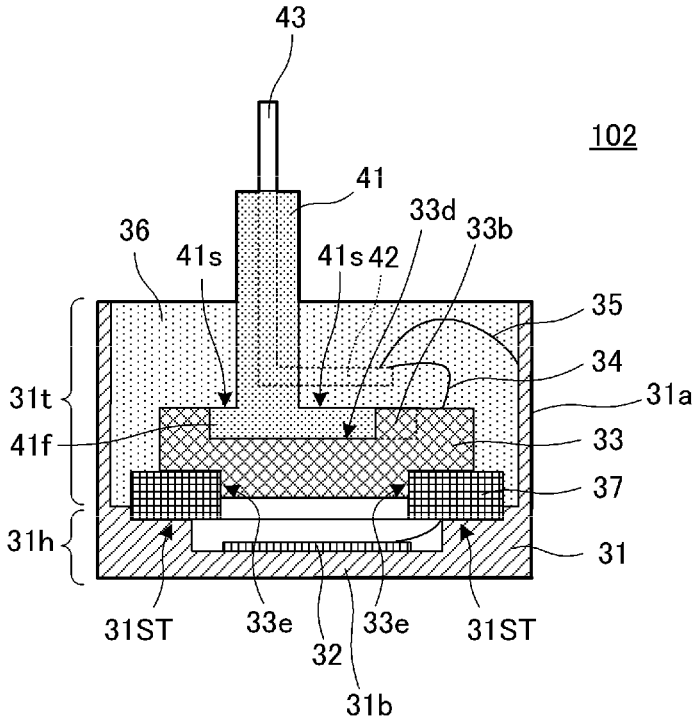
FIG. 5A is a cross-sectional view of an ultrasonic sensor according to a second embodiment of the present invention.
Figure 5B:
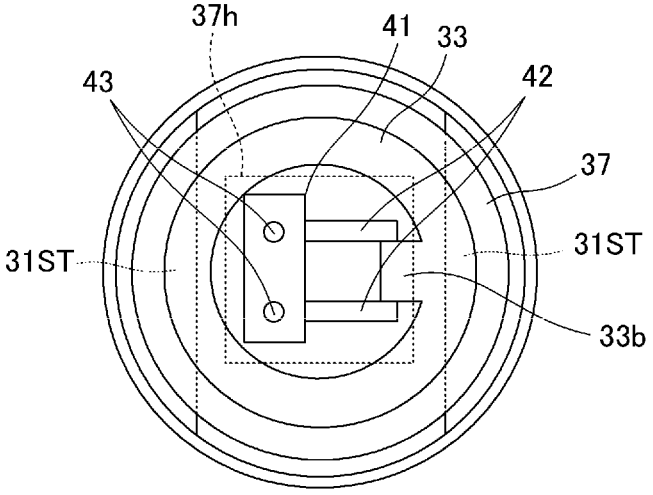
FIG. 5B is a plan view of a state before the case of the ultrasonic sensor of FIG. 5A is internally filled with a filler.

FIG. 5A is a cross-sectional view of an ultrasonic sensor 102 according to a second embodiment of the present invention. FIG. 5B is a plan view of a state before the case 31 of the ultrasonic sensor 102 is internally filled with the filler 36.

The ultrasonic sensor 102 includes a reinforcing member (weight) 37 on the thick portion 31*h* of the case 31. The reinforcing member 37 is located at a position not in contact with the inner periphery of the thin portion 31*t* of the side wall 31*a*. The reinforcing member 37 may be any molded body with high acoustic impedance. For example, a molded body made of the same material as that of the case 31 (aluminum) may be used as the reinforcing member 37 by adjusting the size, such as the thickness. However, it is preferable that the reinforcing member 37 be a molded body made of material (such as stainless steel (SUS) or zinc) higher in density than that of the material of the case 31. Broken lines in FIG. 5B indicate positions of the stepped portions 31ST at the bottom 31*b* of the case 31. A region surrounded by the stepped portions 31ST (indicated by the broken lines in FIG. 5B) at the bottom 31*b* of the case 31 and the inner periphery of the case 31 where the stepped portions 31ST are not present is a main vibration region, which is substantially equivalent to the inner bottom surface of the case 31. The main vibration region of the case 31 is longer in a direction parallel to the broken lines in FIG. 5B and shorter in a direction perpendicular to the broken lines in FIG. 5B. Thus, anisotropy is produced in directivity of ultrasonic waves.

Figure 6:
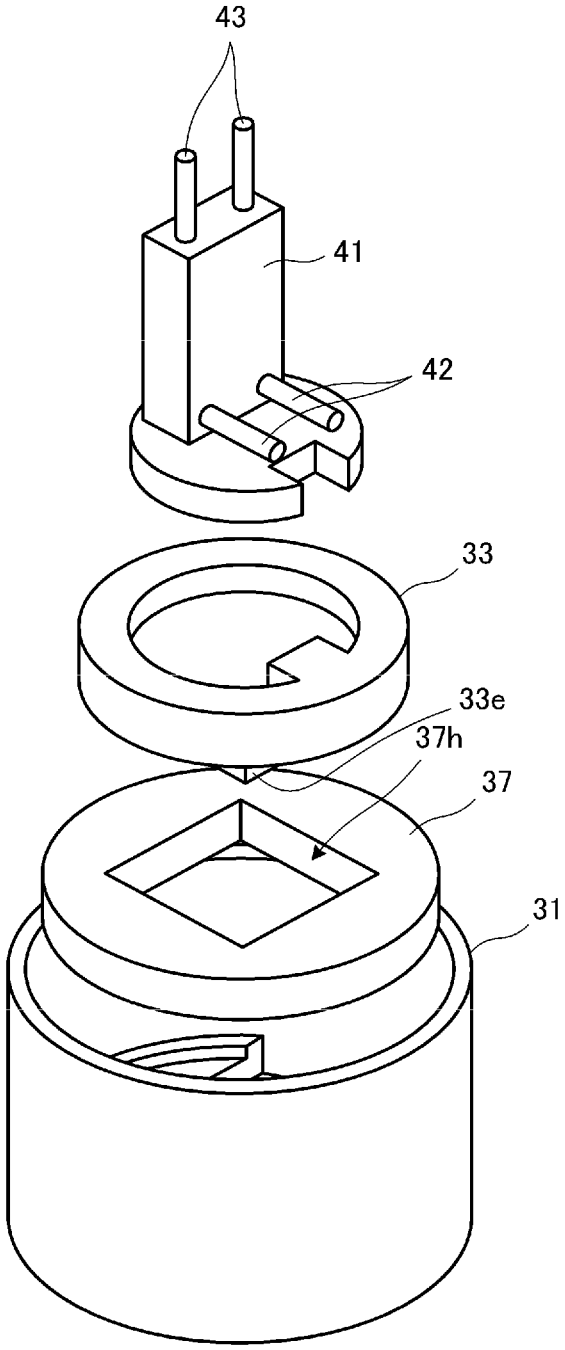
FIG. 6 is an exploded perspective view illustrating a structure of the case, a reinforcing member, the elastic member, and the terminal retainer of the ultrasonic sensor according to the second embodiment.

FIG. 6 is an exploded perspective view illustrating a structure of the case 31, the reinforcing member 37, the elastic member 33, and the terminal retainer 41 of the ultrasonic sensor 102 illustrated in FIG. 5A. The reinforcing member 37 is a substantially annular molded body having a substantially rectangular opening 37*h* in the center thereof. In the lower part of the elastic member 33, there are the first engagement portions 33*e* that engage with the opening 37*h* of the reinforcing member 37. The other configuration is the same as that described in the first embodiment.

The effect of the reinforcing member 37 enhances rigidity of a portion around the inner bottom surface of the case 31. This can not only suppress transmission of vibrations from the bottom 31*b* to the side wall 31*a* of the case 31, but can also allow the bottom 31*b* (vibrating surface) of the case 31 to efficiently vibrate. The sensitivity of the ultrasonic sensor 102 can thus be improved.

Since the opening 37*h* of the reinforcing member 37 and the first engagement portions 33*e* of the elastic member 33 are substantially noncircular, it is possible to maintain the directional property of the terminal retainer 41 with respect to the case 31.

Third Embodiment

Figure 7:
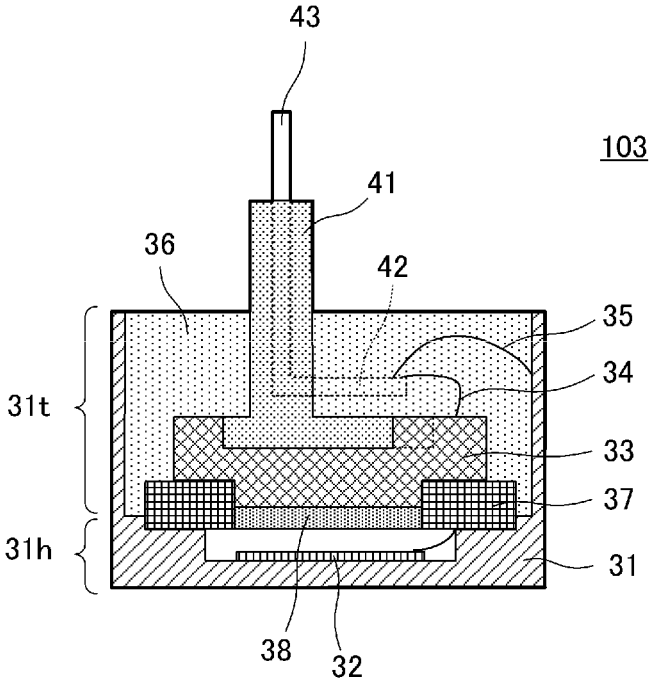
FIG. 7 is a cross-sectional view of an ultrasonic sensor according to a third embodiment of the present invention.

FIG. 7 is a cross-sectional view of an ultrasonic sensor 103 according to a third embodiment of the present invention. The ultrasonic sensor 103 includes the case 31, the piezoelectric element 32, the terminal retainer 41 that holds the outer terminals 43 and the inner terminals 42, the wires (conductive members) 34 and 35 connected to the inner terminals 42 and configured to feed power to the piezoelectric element 32, the reinforcing member 37, a sound absorbing member 38, and the filler 36. The ultrasonic sensor 103 is obtained by adding the sound absorbing member 38 to the lower surface of the elastic member 33 (i.e., the surface adjacent to the piezoelectric element 32) of the ultrasonic sensor 102 illustrated in FIG. 5A. The sound absorbing member 38 is, for example, a polyester felt and is bonded to the elastic member 33 by an adhesive.

As described above, since the sound absorbing member 38 is provided on the lower surface of the elastic member 33 adjacent to the piezoelectric element 32, unwanted sonic waves are absorbed and attenuated by the sound absorbing member 38 before reaching the elastic member 33 and being attenuated inside the elastic member 33. Therefore, it is possible to efficiently attenuate unwanted sonic waves transmitted from the piezoelectric element 32 toward the interior of the case 31. Also, positioning of the sound absorbing member 38 can be easily made.

Fourth Embodiment

Figure 8:
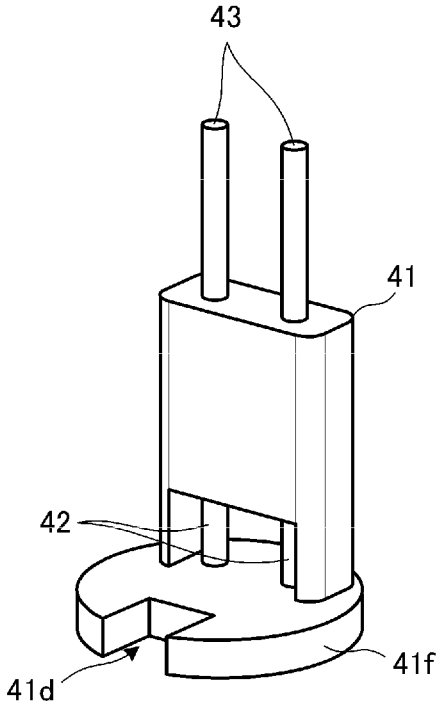
FIG. 8 is a perspective view illustrating shapes of the terminal retainer and the terminals included in an ultrasonic sensor according to a fourth embodiment of the present invention.

FIG. 8 is a perspective view illustrating shapes of the terminal retainer 41 and the inner and outer terminals 42 and 43 included in an ultrasonic sensor according to a fourth embodiment of the present invention. About two pins held by the terminal retainer 41 serve as the outer terminals 43 at one end and the inner terminals 42 at the other end. As illustrated in FIG. 8, it is not necessary that the inner terminals 42 be bent inside the terminal retainer 41, as long as they are exposed to allow connection of wires thereto.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An ultrasonic sensor comprising:

a case including a bottom portion and a side wall portion that define an inner space, wherein the side wall portion of the case has a thin portion defining an opening of the case and a thick portion defining the bottom portion of the case;

a piezoelectric element located within the inner space of the case and adjacent to the bottom portion of the case;

a terminal positioned within the inner space of the case and extending outside the case;

a terminal retainer configured to hold the terminal;

a conductive member connecting the terminal to the piezoelectric element; and an elastic member disposed between the thick portion and the terminal retainer, wherein the thick portion includes a step and the elastic member has an engagement portion that engages with the step of the thick portion.

2. The ultrasonic sensor according to claim 1, wherein the case is a substantially cylindrical case.

3. The ultrasonic sensor according to claim 1, wherein an opening region in the thick portion is covered with the elastic member.

4. The ultrasonic sensor according to claim 1, further comprising a filler located within a space between the thin portion of the side wall portion and a side surface of the elastic member.

5. The ultrasonic sensor according to claim 4, wherein the elastic member has an elastic modulus lower than an elastic modulus of the filler.

6. The ultrasonic sensor according to claim 1, wherein the elastic member has a second engagement portion that engages with the terminal retainer.

7. The ultrasonic sensor according to claim 1, further comprising a reinforcing member positioned between the thick portion and the elastic member.

8. The ultrasonic sensor according to claim 7, wherein reinforcing member has an acoustic impedance higher than that of the case.

9. The ultrasonic sensor according to claim 1, further comprising a sound absorbing member on a surface of the elastic member adjacent to the piezoelectric element.

10. The ultrasonic sensor according to claim 1, wherein the step is configured to produce anisotropy in a major axis direction and a minor axis direction;

the elastic member has a second engagement portion that engages with the terminal retainer; and the terminal retainer has a flange that engages with the second engagement portion.

11. The ultrasonic sensor according to claim 1, wherein the terminal includes a bent terminal portion within the inner space of the case.

* * * * *